US006592206B1

(12) United States Patent
Suzuki et al.

(10) Patent No.: US 6,592,206 B1
(45) Date of Patent: Jul. 15, 2003

(54) PRINT HEAD AND MANUFACTURING METHOD THEREOF

(75) Inventors: Isao Suzuki, Shizuoka-ken (JP); Masashi Shimosato, Shizuoka-ken (JP); Hiroshi Ito, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 75 days.

(21) Appl. No.: 09/692,745

(22) Filed: Oct. 19, 2000

(30) Foreign Application Priority Data

Oct. 22, 1999 (JP) ..... 11-301273

(51) Int. Cl.[7] ..... B41J 2/135; B41J 2/14

(52) U.S. Cl. ..... 347/45; 347/47

(58) Field of Search ..... 347/45, 46–47, 347/55, 14–15, 75–76, 77–78, 44, 48

(56) References Cited

U.S. PATENT DOCUMENTS

| | | | | |
|---|---|---|---|---|
| 5,208,604 A | | 5/1993 | Watanabe et al. | 347/47 |
| 5,442,383 A | * | 8/1995 | Fuse | 347/14 |
| 5,467,115 A | * | 11/1995 | Childers | 347/47 |
| 5,517,000 A | | 5/1996 | Nishiwaki et al. | 219/121.77 |
| 5,812,158 A | * | 9/1998 | Murthy et al. | 347/45 |
| 5,971,528 A | * | 10/1999 | Yoshimura | 347/47 |
| 6,079,814 A | * | 6/2000 | Lean et al. | 347/55 |

FOREIGN PATENT DOCUMENTS

| | | |
|---|---|---|
| JP | 05-330064 | 12/1993 |
| JP | 10-076666 | 3/1998 |
| JP | 10-291318 | 11/1998 |
| JP | 10-305584 | 11/1998 |

OTHER PUBLICATIONS

Copy of related U.S. patent application Ser. No. 09/498,443 filed Feb. 4, 2000; Inventor: Isao Suzuki; Title: Apparatus for Producing a Printer Head and Aperture Processing Device.

* cited by examiner

*Primary Examiner*—Lamson Nguyen
*Assistant Examiner*—K. Feggins
(74) *Attorney, Agent, or Firm*—Frishauf, Holtz, Goodman & Chick, P.C.

(57) ABSTRACT

A print head includes an orifice plate having a plurality of orifices arranged as ink-jet nozzles, and a head body partitioned into a plurality of ink chambers and integrated with the orifice plate such that ink is guided from the ink chambers to the orifices, for increasing an internal pressure of each ink chamber to eject ink from a corresponding orifice. Particularly, each orifice has a constriction for restricting an ink-jet error angle to a range of ±5 mrad with respect to a center axis thereof.

20 Claims, 9 Drawing Sheets

PRINT HEAD AND MANUFACTURING METHOD THEREOF

CROSS-REFERENCE TO RELATED APPLICATIONS

This application is based upon and claims the benefit of priority from the prior Japanese Patent Application No. 11-301273, filed Oct. 22, 1999, the entire contents of which are incorporated herein by reference.

BACKGROUND OF THE INVENTION

The present invention relates to a print head for printing a dot image with drops of ink jet or ejected from ink-jet nozzles, and also relates to a manufacturing method of the print head in which the ink-jet nozzles are formed by laser irradiation.

In a typical ink-jet printer, a print head comprises a head body and an orifice plate attached to an end of the body. The orifice plate includes a plurality of orifices arranged as a raw of ink-jet nozzles. The head body includes a plurality of ink chambers separated by partition walls and an ink-jet actuator of a bubble-jet or Kaiser type, which varies internal pressures of the ink chambers to eject ink. The bubble-jet type ink-jet actuator increases the internal pressure of each ink chamber by generating a bubble at the time of ink ejection. The Kaiser type ink-jet actuator increases the internal pressure of each ink chamber by deforming the partition walls at the time of ink ejection.

The orifice plate is a metal plate in which the plurality of orifices are formed by a plating method generally called electroforming so as to have a forward taper that the orifice diameter gradually decreases in a direction from an ink supply side to an ink discharge side, and which is bonded to the head body with an adhesive. With this plate structure, it is difficult that the orifice pitch is reduced to print a dot image with a higher resolution. Namely, the adhesive flows from the main plate surface into an adjacent orifice during the orifice plate bonding process and easily causes clogging which hinders ink ejection. When the orifice pitch has already been reduced to a value limited by the reason described above, the resolution of a dot image is enhanced using a driving scheme of repeatedly driving the print head while shifting the print head at a pitch narrower than the orifice pitch in a direction that the orifices are arranged. This driving scheme, however, has a drawback that the dot printing position varies due to dependence on the accuracy of a mechanism for shifting the print head, making it difficult to obtain a clear dot image.

Jpn. Pat. Appln. KOKAI Publication No. 5-330064 discloses a technique capable of solving the above-mentioned problem. In this technique, an orifice plate is made of a resin plate previously attached to an end of a head body, and has a plurality of orifices formed by irradiating a laser beam to the resin plate from the ink discharge side. The laser beam is converged by an imaging optical system so that the beam diameter becomes minimum at a focal plane set in a space on the ink discharge side. The laser beam is diverged from the focal plane and reaches the resin plate. In the resin plate, ablation proceeds at portions exposed to the laser beam, to thereby form an orifice of a forward taper that the orifice diameter gradually decreases in a direction from the ink supply side to the ink discharge side.

With this technique, since there is no adhesive flowed into the orifice to cause clogging, the orifice pitch can be sufficiently reduced to print a dot image with a higher resolution. However, if a constant positional relationship between the resin plate and the focal plane of the imaging optical system cannot be maintained for each orifice, the minimum orifice diameter varies due to divergence of the laser beam, making it difficult to print dots of a uniform size.

Further, Jpn. Pat. Appln. KOKAI Publication No. 10-76666 discloses an orifice formation technique capable of reducing the irregularity in the minimum orifice diameter. In this technique, a plurality of orifices are formed by irradiating laser beams from the ink supply side and the ink discharge side to a resin plate. The laser beam from the ink supply side is converged by an imaging optical system so that the beam diameter becomes minimum at a focal plane set in a space on the ink discharge side. The laser beam reaches the resin plate on the way to the focal plane. In the resin plate, ablation proceeds at portions exposed to the laser beam, to thereby form an orifice of a forward taper that the orifice diameter gradually decreases in a direction from the ink supply side to the ink discharge side. The laser beam from the ink discharge side is converged by the imaging optical system so that the beam diameter becomes minimum at a focal plane set at a space on the ink supply side. The laser beam reaches the resin plate on the way to the focal plane. In the resin plate, ablation proceeds at portions exposed to the laser beam, to thereby shape the orifice into a reverse taper near the resin plate surface located on the ink discharge side. This structure compensates for variations in the orifice diameters on the ink discharge side. However, the orifice formation technique requires the laser beam irradiated from the ink supply side onto the resin plate to form each orifice, it is difficult that the resin plate is previously attached to the head body end without adversely affecting the laser beam irradiation. If the resin plate is bonded to the head body with an adhesive after the orifice formation, there is a possibility that, as mentioned above, the adhesive flows from a main plate surface into an adjacent orifice and clogs it. Accordingly, the orifice pitch cannot be sufficiently reduced to print a high-resolution dot image. Since the laser beams are irradiated to the resin plate from the ink discharge side and from the ink supply side, displacement of the boundary between the forward taper and the reverse taper easily occurs in each orifice due to an alignment error of the laser beams. This displacement causes turbulence in a flow of ink which is supplied to the orifice for ejection by changing the internal pressure of the ink chamber. As a result, each ink drop is not ejected in a uniform direction.

BRIEF SUMMARY OF THE INVENTION

An object of the present invention is to provide a print head and a manufacturing method thereof for improving a print resolution without degrading print quality.

According to the present invention, there is provided a print head which comprises an orifice plate having a plurality of orifices arranged as ink-jet nozzles; and a head body partitioned into a plurality of ink chambers and integrated with the orifice plate such that ink is guided from the ink chambers to the orifices, for increasing an internal pressure of each ink chamber to eject ink from a corresponding orifice, wherein each orifice has a constriction for restricting an ink-jet error angle to a range of ±5 mrad with respect to a center axis thereof.

According to the present invention, there is provided a print head manufacturing method which comprises a bonding step of bonding an orifice plate to a head body partitioned into a plurality of ink chambers by an adhesive, a perforation step of forming a plurality of orifices in the orifice plate by irradiating a laser beam such that the orifices are arranged as ink-jet nozzles communicated with the ink chambers to eject ink upon increase in the internal pressures of the ink chambers, wherein the perforation step includes a shaping step of shaping each orifice by converging the laser beam using an imaging optical system whose focal plane is set inside the orifice plate so as to simultaneously form in the orifice a forward taper whose aperture size gradually decreases to a predetermined value in a thickness direction of the orifice plate from an ink supply side to an ink discharge side, and a non-forward taper communicated with the forward taper.

In the print head described above, the constriction of each orifice restricts the ink-jet error angle to a range of ±5 mrad with respect to a center axis of the orifice. Therefore, positional deviation is reduced to 1 $\mu$m or less in a plane distanced by 1 mm from the orifice. Thus, the print quality is not degraded even when the print resolution is improved.

Further, in the print head manufacturing method described above, the shaping step shapes each orifice by converging the laser beam using an imaging optical system whose focal plane is set inside the orifice plate so as to simultaneously form in the orifice a forward taper whose aperture size gradually decreases to a predetermined value in a thickness direction of the orifice plate from an ink supply side to an ink discharge side, and a non-forward taper communicated with the forward taper. That is, it is not necessary to irradiate laser beams from the both sides of the orifice plate. Accordingly, even if the bonding step is performed prior to the perforation step, each orifice can be formed in the perforation step by irradiating a laser beam to that surface of the orifice which is located on the ink discharge side. Since the orifice is formed after the bonding step, it is possible to prevent clogging caused by an adhesive flowed into the orifice. Further, the constriction of each orifice sufficiently reduces an ink-jet error angle with respect to the center axis of the orifice, so that the print resolution can be improved without degrading the print quality.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printing unit according to an embodiment of the present invention will be described with reference to the accompanying drawings.

Figure 1:
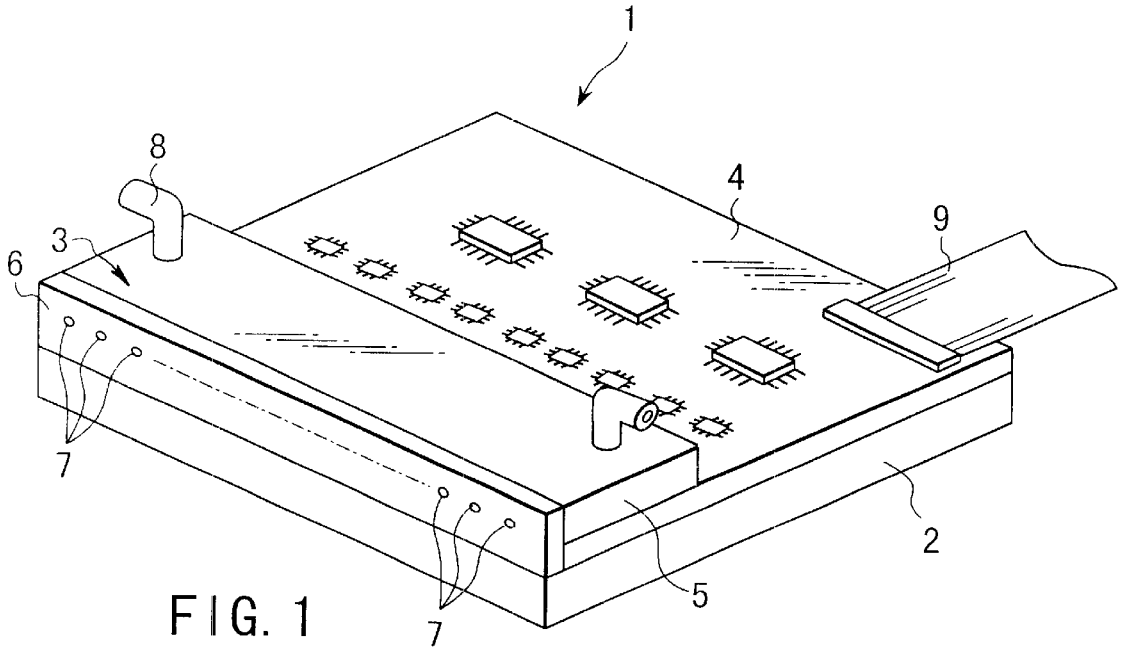
FIG. 1 is a perspective view of an ink-jet printing unit according to an embodiment of the present invention.

FIG. 1 is a perspective view of the ink-jet printing unit 1. The ink-jet printing unit 1 comprises a base plate 2 serving as a support member, a print head 3 for printing a dot image with drops of ink, and a driver circuit board 4 for driving the print head 3. The print head 3 and the driver circuit board 4 are mounted on the base plate 2. The print head 3 includes a head body 5 and an orifice plate 6 integrated to the head body 5. The orifice plate 6 contains a plurality of orifices 7 as a raw of ink-jet nozzles arranged at a specified pitch of 80 $\mu$m or less. The head body 5 is connected to an ink tube 8 for supplying and discharging ink.

Figure 2:
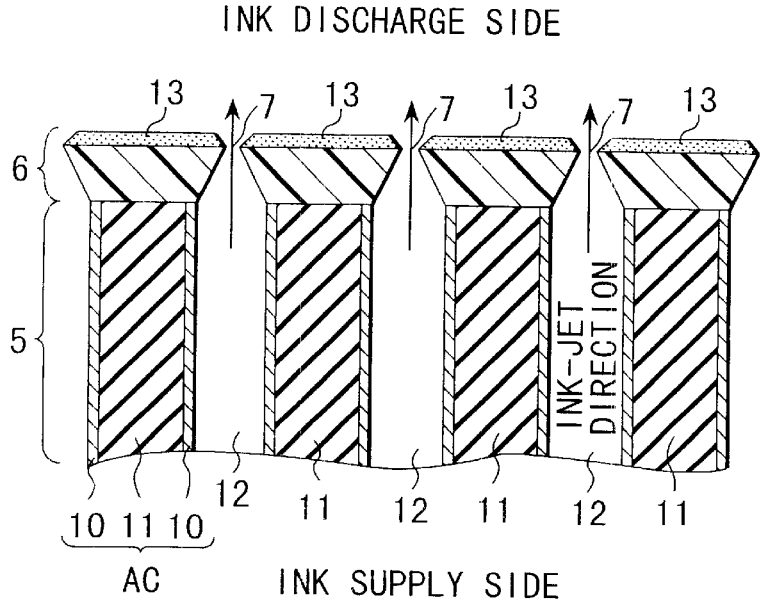
FIG. 2 is a sectional view of a print head in FIG. 1.

FIG. 2 is a sectional view of the print head 3 along the orifices 7. The head body 5 comprises a plurality of ink chambers 12 formed as fine slots guiding ink to the orifices 7 and an ink-jet actuator AC of a Kaiser type for changing an internal pressure of each ink chamber to eject ink from a corresponding one of the orifices 7 in an ink-jet direction indicated by an arrow in FIG. 2. The ink-jet actuator AC comprises a plurality of partition walls 11 which are made of an electrostrictive member and partition the head body 5 into a plurality of ink chambers 12, and a plurality of electrodes 10 attached to hold the partition walls 11 therebetween. The ink-jet actuator AC increases the internal pressure of each ink chamber 12 at a time of ink ejection by selectively applying a voltage to corresponding electrodes 10 to deform corresponding partition walls 11. The driver circuit board 4 comprises a plurality of IC chips and the like for driving the ink-jet actuator AC of the print head 3 and is connected through a connection cable 9 to an external controller.

The orifice plate 6 is constituted by a lamination member of a resin plate 14 and a liquid-repellent film 13 which covers the resin plate 14 for repelling ink on the ink discharge side. The liquid-repellent film 13 is made of a polymer resin material such as polyimide which features a high absorption coefficient for light having an ultraviolet wavelength. This lamination member is perforated to form the orifices 7 whose diameters are regulated to 30 $\mu$m or less. The orifices 7 are respectively brought into communication with the ink chambers 12 in a state where the orifice plate 6 is attached to the end of the head body 5. Each orifice 7 has a constriction obtained by a combination of a reverse taper formed on the ink discharge side and a forward taper formed on the ink supply side. The reverse taper is provided for helping to eject the ink drop along the center axis of the orifice 7 when the internal pressure of the ink chamber 12 is increased, thereby improving ink ejection efficiency.

Figure 3:
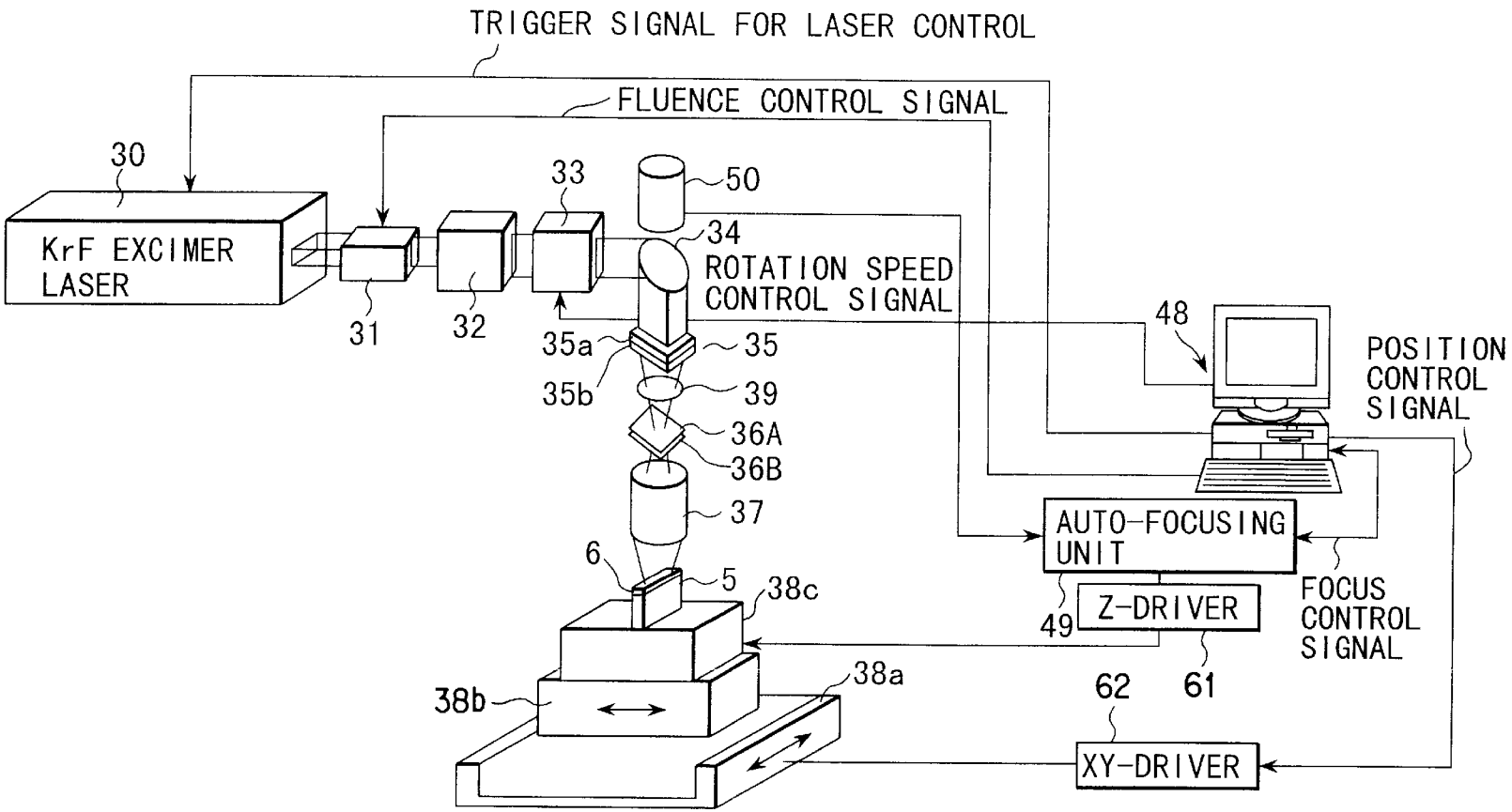
FIG. 3 shows a configuration of a perforation apparatus used for manufacturing the print head in FIG. 2.

FIG. 3 shows a configuration of a perforation apparatus used for manufacturing the print head in FIG. 2. The orifices 7 of the orifice plate 6 are formed by means of the perforation apparatus. The perforation apparatus comprises a KrF excimer laser oscillator 30, a variable attenuator 31, an up-collimator 32, an image rotator 33, a mirror 34, an array lens lighting system 35, a first mask 36A, a second mask 36B, a projection lens (or image formation lens) 37, an X-stage 38*a*, a Y-stage 38*b*, a Z-stage 38*c*, a relay lens 39, a microscopic process controller 48, an auto-focusing unit 49, a camera 50, a Z-driver 61, and an XY-driver 62.

The KrF excimer laser oscillator 30 generates a laser beam whose wavelength is in an ultraviolet range of 400 nm or less. The variable attenuator 31, the up-collimator 32, the image rotator 33, and the mirror 34 are arranged on an optical path for the laser beam output from the KrF excimer laser oscillator 30. The array lens lighting system 35, the relay lens 39, the mask 36A, the mask 36B, and the projection lens 37 are arranged on an optical path for the laser beam reflected by the mirror 34. The X-stage 38*a*, the Y-stage 38*b*, and the Z-stage 38*c* are arranged in an optical axis direction of the projection lens 37 and cause the orifice plate 6 of the print head 3 mounted as a work piece on the Z-stage 38*c* to be movable in X-axis, Y-axis, and Z-axis directions, respectively.

The microscopic process controller 48 controls operations of the KrF excimer laser oscillator 30, the image rotator 33, the variable attenuator 31, the auto-focusing unit 49, the Z-driver 61, and the XY-driver 62. The KrF excimer laser oscillator 30 responds to a trigger signal sent from the controller 48 and outputs 200 pulses of the laser beam required for perforation of the orifice plate 6. The image rotator 33 continuously rotates at a speed determined by a rotation speed control signal from the controller 48 for a preset period, during which the laser beam pulses are output from the oscillator 30, for example. The variable attenuator 31 is controlled by an influence control signal from the controller 48 to regulate output intensity of the laser beam according to the number of pulses of the laser beam. The auto-focusing unit 49 is controlled by a focus control signal from the controller 48 to perform a focusing operation such that a mask image is sharply formed on the orifice plate 6. In the focusing operation, the auto-focusing unit 49 detects a focus error from the mask image formed on the orifice plate 6 and captured by the camera 50 connected thereto, and outputs a drive signal for causing the Z-driver 61 to move the orifice plate 6 such that the focus error is reduced. The XY-driver 62 is controlled by a position control signal from controller 48 to move the orifice plate 6 such that the mask image is located at a specified position on the orifice plate 6.

Figure 4:
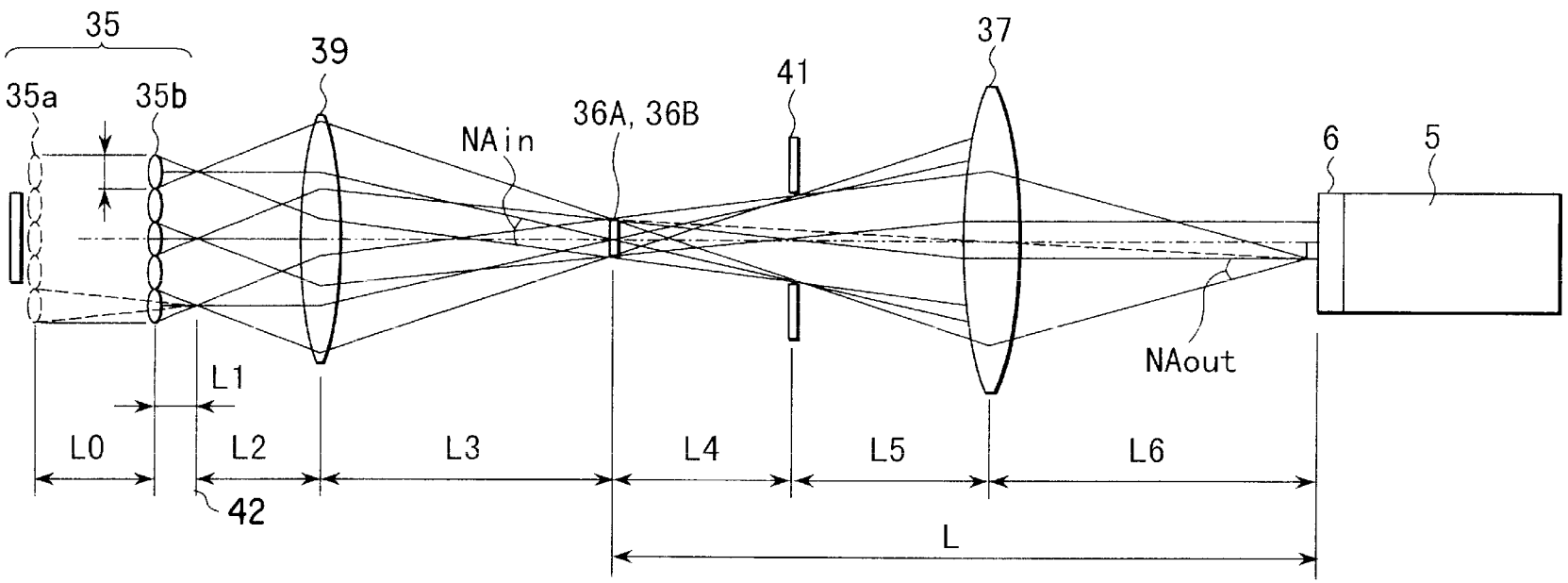
FIG. 4 shows a configuration of an optical system arranged for the perforation apparatus in FIG. 3.
Figure 5:
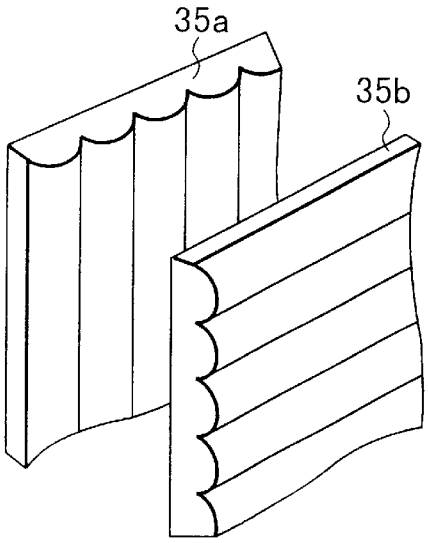
FIG. 5 schematically illustrates a configuration of a cylindrical lens in FIG. 4.

The following describes a specific configuration of the optical system which comprises the array lens lighting system 35, the relay lens 39, the masks 36A and 36B, and the projection lens 37, with reference to FIGS. 4 and 5. As shown in FIG. 4, the array lens lighting system 35, the relay lens 39, the first mask 36A, the second mask 36B, and the projection lens 37 are provided on the optical path of the laser beam. The array lens lighting system 35 includes two cylindrical lenses 35*a* and 35*b* which are separated by a distance L0 as shown in FIG. 4 and opposed to be orthogonal as shown in FIG. 5. The focal points of the cylindrical lenses 35*a* and 35*b* are located within an identical focal plane 42, which is spaced at a distance L1 from the cylindrical lens 35*b*. The first mask 36A and the second mask 36B are arranged relatively to the array lens lighting system 35, the relay lens 39, the incidence iris 41, and the projection lens 37 so that the laser beam from the focal plane 42 of the cylindrical lenses 35*a* and 35*b* can be guided by the relay lens 39 and imaged on the plane of an incidence iris (aperture diaphragm) 41 for the projection lens 37, thereby satisfying a condition of forming a telecentric optical system for the projection lens 37. The laser beam obtained through the telecentric optical system is irradiated to a surface of the orifice plate 6 from the ink discharge side, so that the orifice 7 having the reverse and forward tapers is formed with a center axis perpendicular to the surface of the orifice plate 6.

Figure 7A:
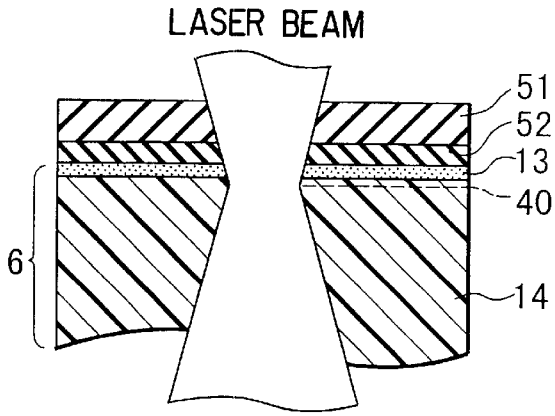
FIGS. 7A and 7B are sectional views illustrating an orifice formed by irradiating a laser beam to the orifice plate in FIG. 6.
Figure 6:
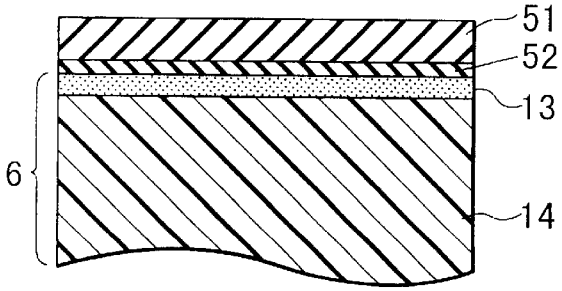
FIG. 6 is a sectional view showing a structure of an orifice plate before formation of orifices by the perforation apparatus in FIG. 3.

A process of forming the orifice 7 in the orifice plate 6 is performed using the perforation apparatus, in the specific manner described below. FIG. 6 shows a structure of the orifice plate 6 (plate to be perforated) before the perforation apparatus forms orifices. The orifice plate 6, that is, the lamination member of the resin plate 14 and the liquid-repellent film 13 is obtained by covering a surface of the resin plate 14 with the liquid-repellent film 13. A protective film 51 for protecting the liquid-repellent film 13 is temporarily affixed to the liquid-repellent film 13 with an adhesive 52. The laser beam is shaped by the perforation apparatus and irradiated from the ink discharge side of the orifice plate 6 as shown in FIG. 7A. By passing through the telecentric optical system of the perforation apparatus, the laser beam is shaped to have a constriction that its sectional area perpendicular to the irradiation direction gradually decreases toward a focal plane 40 and gradually increases from the focal plane 40.

Figure 7B:
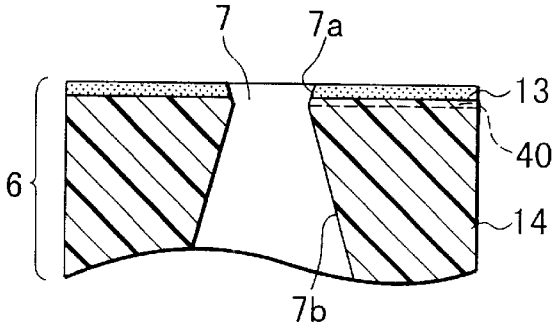

In this embodiment, the laser beam is irradiated in a state where the focal plane 40 is located inside the orifice plate 6, so that a constriction is obtained in the orifice 7 as a combination of reverse and forward tapers 7*a* and 7*b* whose boundary is located to the focal plane 40. Irradiation of the laser beam from the ink discharge side is performed in a state where the orifice plate 6 is covered with the protective film 51. After irradiation of the laser beam, the protective film 51 is removed to obtain the completed orifice plate 6 shown in FIG. 7B. The protective film 51 is provided for enhancing perforation made by absorbing the laser beam, and for suppressing irregularity in the edge shapes of the liquid-repellent film 13 surrounding the orifices 7.

Figure 8A:
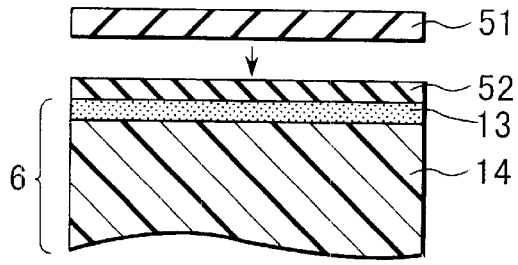
FIGS. 8A to 8D show manufacturing steps of the print head in FIG. 2.
Figure 8B:
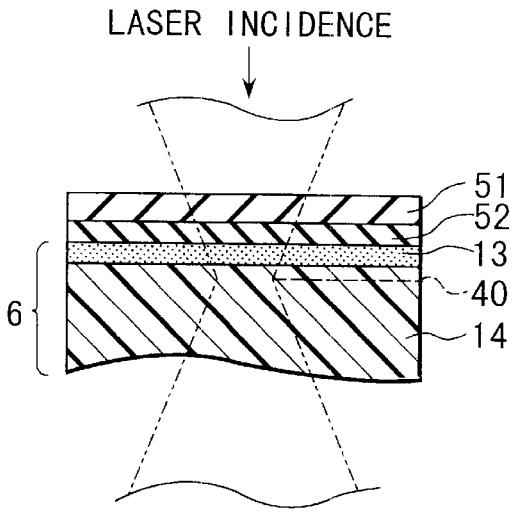
Figure 8C:
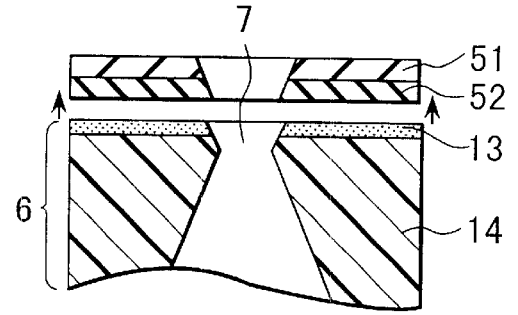
Figure 8D:
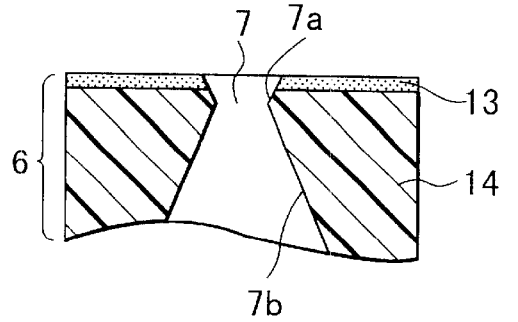

All the formation steps of the orifice 7 are described in further detail below. As shown in FIG. 8A, the protective film 51 is bonded to the liquid-repellent film 13 which formed as an ink-repellent surface of the orifice plate 6 and coated by the adhesive 52. As shown in FIG. 8B, the perforation apparatus is controlled to irradiate a constricted laser beam from the ink discharge side to the orifice plate 6 protected with the protective film 51. As shown in FIG. 8C, after perforation made by the laser irradiation, the protective film 51 is removed together with the adhesive 52 from the orifice plate 6. As a result, the orifice 7 having a constriction shown in FIG. 8D is formed in the orifice plate 6.

The series of steps is performed in a state where the orifice plate 6 is has been fixed to the head body 5. Since the orifice 7 is formed in this state, it is possible to prevent clogging caused by an adhesive flowed into the orifice 7.

In addition, the shape of the laser beam may be changed by controlling the perforation apparatus to obtain a different constriction in the orifice 7.

Figure 9A:
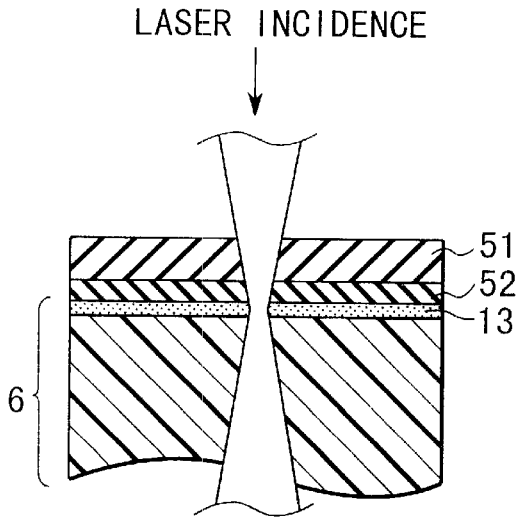
FIGS. 9A and 9B are sectional views illustrating an orifice formed to have a straight portion by irradiating a fine laser beam to the orifice plate in FIG. 6.
Figure 9B:
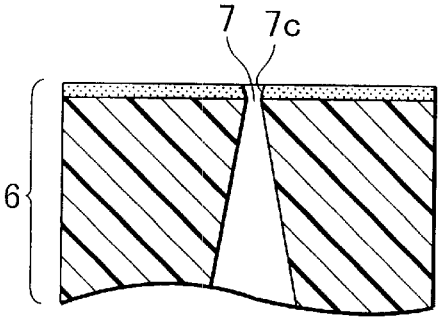

For example, when the diaphragm angle θ for the laser beam to be irradiated to the orifice plate 6 is decreased as shown in FIG. 9A, the orifice 7 can be formed with a straight portion 7*c* and almost no taper near the focal plane 40 as shown in FIG. 9B.

Further, by controlling the perforation apparatus such that the focal plane 40 located inside the orifice plate 6 is shifted in the thickness direction of the orifice plate 6, it is possible to change the depth W of the reverse taper 7*a* determined by the constriction of the laser beam.

Figure 10:
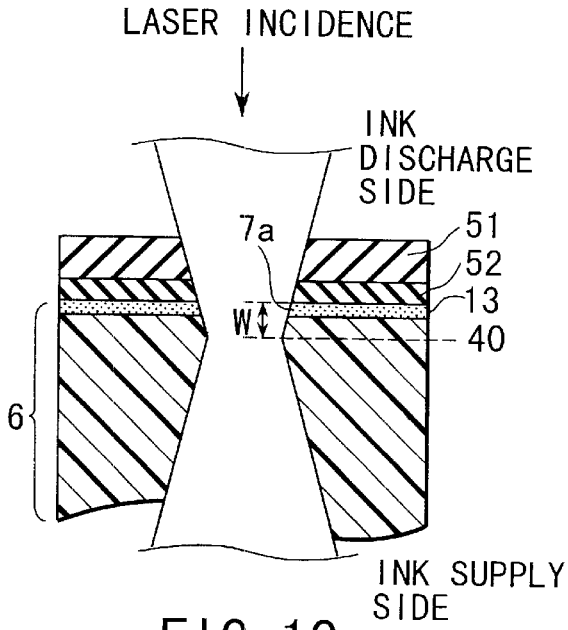
FIG. 10 is a sectional view illustrating an orifice formed when a laser beam is irradiated to the orifice plate in FIG. 6 with a focal plane shifted to an ink discharge side.
Figure 11:
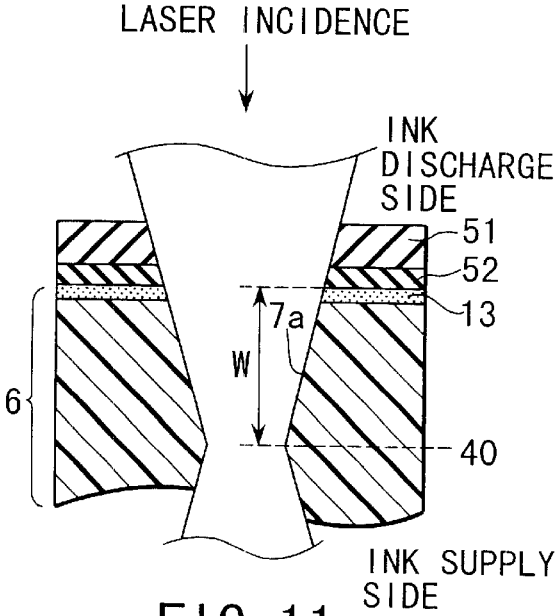
FIG. 11 is a sectional view illustrating an orifice formed when a laser beam is irradiated to the orifice plate in FIG. 6 with a focal plane shifted to an ink supply side.

For example, when the focal plane 40 is shifted to the ink discharge side in the thickness direction of the orifice plate 6, the depth W of the reverse taper 7*a* can be reduced in the orifice 7 as shown in FIG. 10. On the other hand, when the focal plane 40 is shifted to the ink supply side in the thickness direction of the orifice plate 6, the depth W of the reverse taper 7*a* can be increased in the orifice 7 as shown in FIG. 11.

Since the forward taper 7*b* serves to increase a pressure applied to ink in the orifice 7, the ink can be ejected with a small ejection force when the forward taper 7*b* is deep. If the reverse taper 7*a* is deeper than the forward taper 7*b* in the orifice 7, the ink ejection force for ejecting ink from the reverse taper 7*a* remarkably decreases at a time of ejection. This causes a problem such as decreasing an ink ejection speed. If the reverse taper 7*a* is too deep, it is difficult for the ink to straightly flow in the ink-jet direction. Accordingly, it is preferable that the depth W is set to a half or less of the total length of the orifice 7. This also applies to the orifice 7 having the straight portion 7*c* in FIG. 9B. By adjusting the position of the focal plane 40 in the orifice plate 6, the orifice 7 can be formed with the forward taper 7*b* whose depth is regulated to an optimal value.

In this embodiment mentioned above, the reverse taper 7*a* and the forward taper 7*b* can be simultaneously formed in a single step of irradiating a laser beam to be constricted in the orifice plate 6.

Figure 12A:
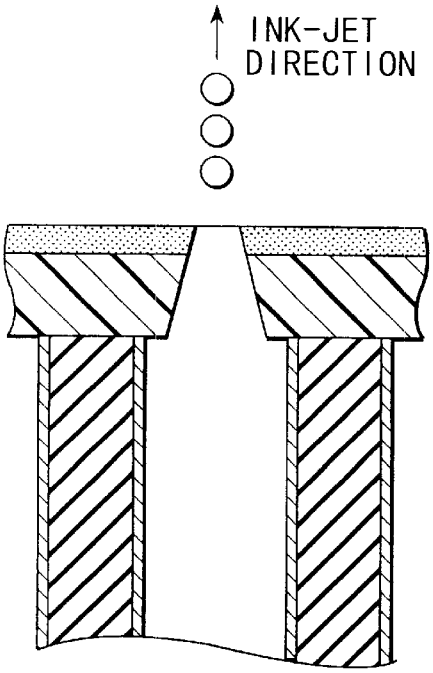
FIGS. 12A and 12B are sectional views respectively showing an orifice having a forward taper and an orifice having forward and reverse tapers, for evaluating ink-jet characteristics.

The following describes differences in ink-jet characteristics according to orifice shapes. FIG. 12A shows an orifice 7 having a forward taper through which ink is ejected in the ink-jet direction indicated by an arrow. The forward taper 7*b* is formed to have a taper angle of 12° and a depth of 30 μm in the orifice plate 6 whose thickness is 30 μm.

Figure 12B:
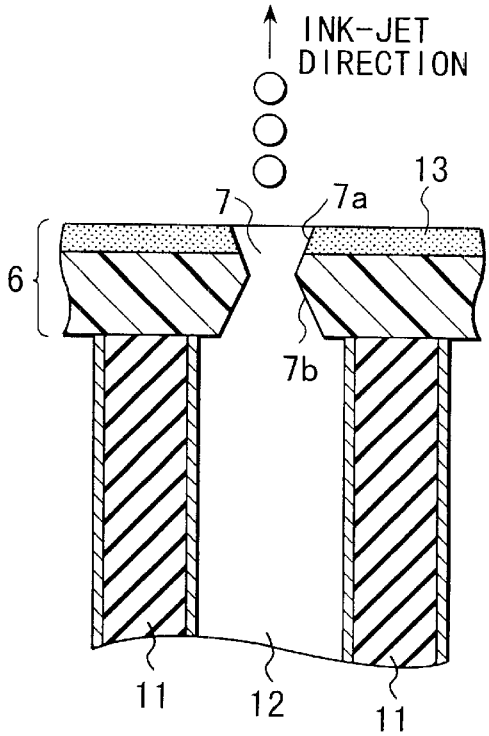

FIG. 12B shows an orifice 7 having a reverse taper 7*a* and a forward taper 7*b* through which ink is ejected in the ink-jet direction indicated by an arrow. These tapers 7*a* and 7*b* are formed in connection with each other to have a common taper angle of 12° and depths of 5 μm and 25 μm respectively in the orifice plate 6 whose the thickness is 30 μm.

Figure 13:
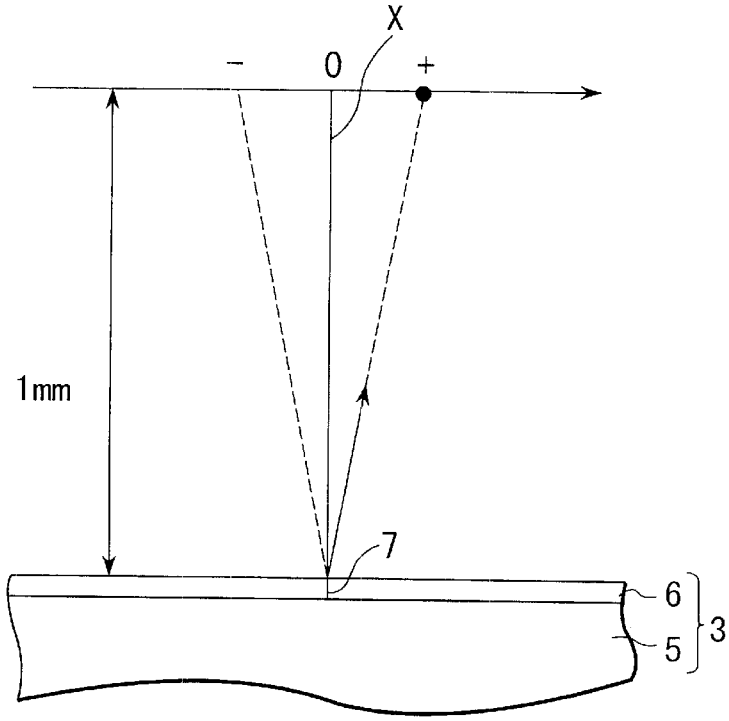
FIG. 13 is a view illustrating a measuring method for ejected ink.

For evaluating ink-jet characteristics, as shown in FIG. 13, an ink drop ejected from each orifice 7 of the print head 3 is captured by a high-speed camera to measure an ink-jet error angle obtained as a positional deviation of the ink drop which reaches a plane distanced by 1 mm from the orifice 7 along the center axis X of the orifice 7. Specifically, a measuring module attached to the high-speed camera measures a positional deviation of the ink drop from a microscopic image obtained by caption.

Figure 14:
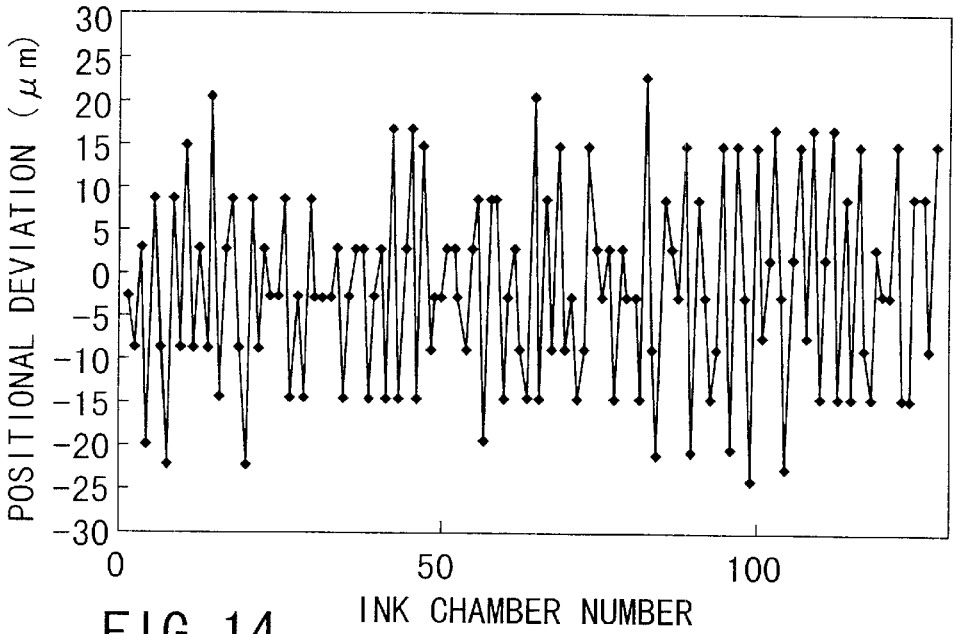
FIG. 14 is a graph showing ink-jet characteristics of the orifice in FIG. 12A.
Figure 15:
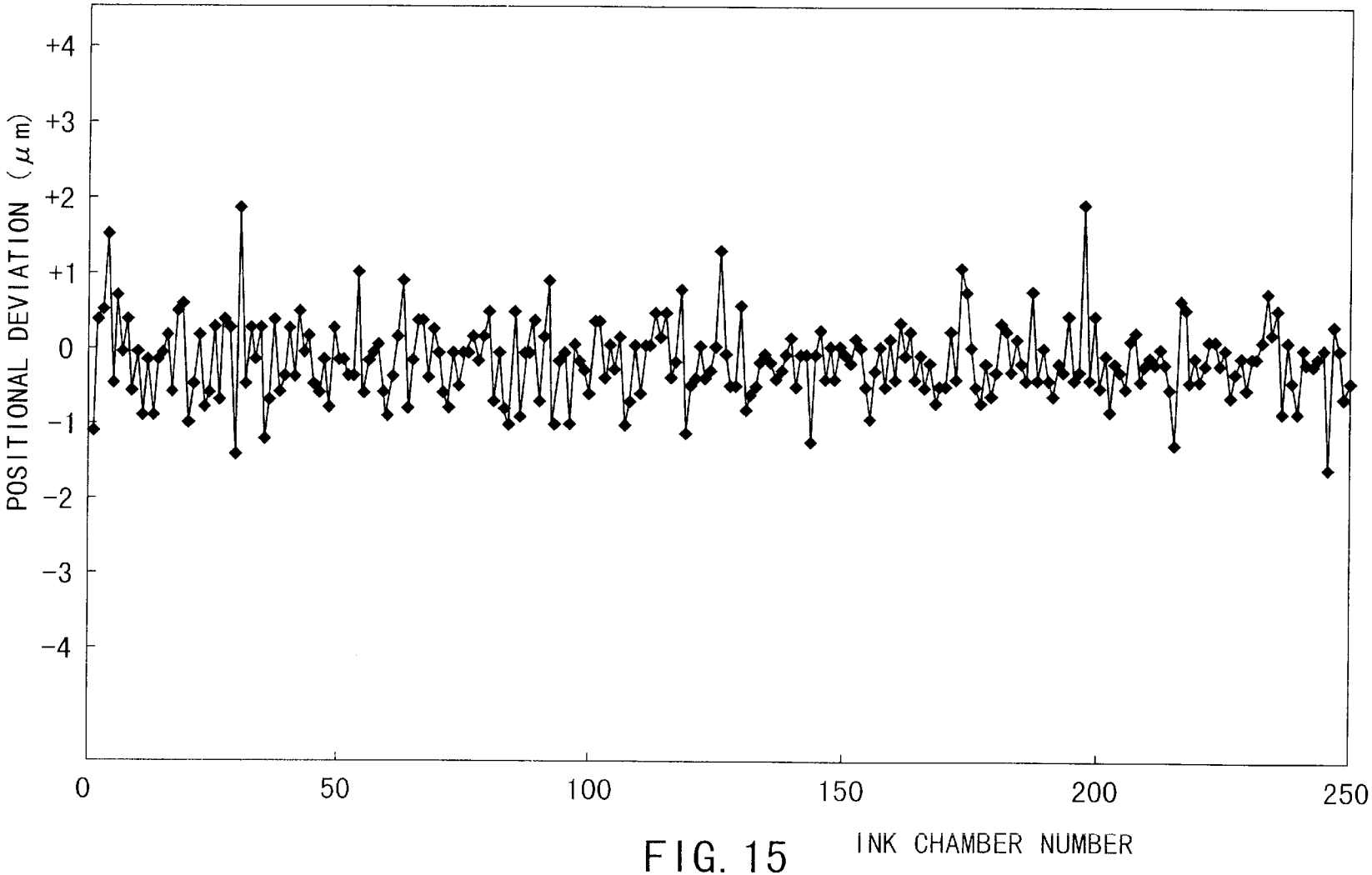
FIG. 15 is a graph showing ink-jet characteristics of the orifice in FIG. 12B.

FIG. 14 shows ink-jet characteristics of the orifice 7 in FIG. 12A, and FIG. 15 shows ink-jet characteristics of the orifice 7 in FIG. 12B. In each of FIGS. 14 and 15, an ink chamber number is indicated in the abscissa axis, and a positional deviation is indicated in the ordinate axis.

When the print head 3 has the orifice plate 6 whose orifices 7 are formed in a shape shown in FIG. 12A, a dot printing position where an ink drop reaches deviates from the center axis of the orifice 7 for a maximum of ±20 μm or more as shown in FIG. 14. This corresponds to an ink-jet error angle of ±20 mrad. In a case where a line of dots are printed at an image density of 300 dpi, a deviation of approximately 10 μm in the dot printing position is visible to the naked eye as a defect of the line. Since the orifice in FIG. 12A causes a large ink-jet error angle described above, excellent image quality cannot be obtained in a dot image printed by the print head 3.

When the print head 3 has the orifice plate 6 whose orifices 7 are formed in a shape shown in FIG. 12B, a dot printing position where an ink drop reaches deviates from the center axis of the orifice 7 for a maximum of ±5 μm as shown in FIG. 15. This corresponds to an ink-jet error angle of ±5 mrad. According to FIG. 15, variation of the ink-jet error angle is maintained stable in a small range. This is because the reverse taper 7*a* serves to more smoothly eject ink flowed out from the forward taper 7*b* as ink drops.

Figure 16:
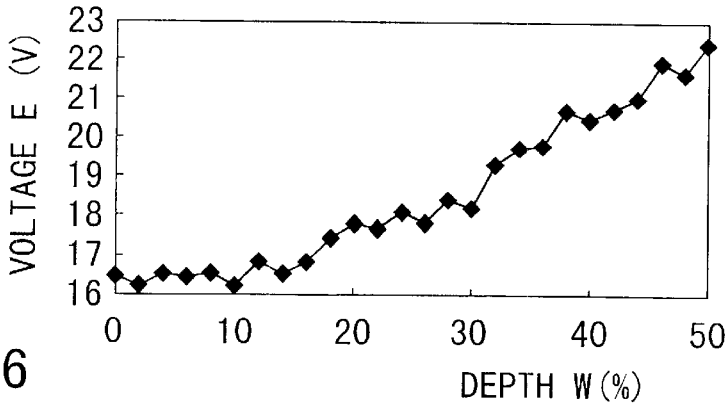
FIG. 16 is a graph showing a relationship between an ejection voltage and a depth of the reverse taper in FIG. 12B.

An ejection voltage E required for the ink-jet actuator AC to eject ink has been measured with respect to the depth W of the reverse taper 7*a*. A result of measurement is shown in FIG. 16. In FIG. 16, the depth W of the reverse taper 7*a* is presented in its ratio to the thickness of the orifice plate 6 (a lamination member of the resin plate 14 and the liquid-repellent film 13). It can be seen from the result that the ejection voltage E increases according to an increase in the depth W of the reverse taper 7*a*. Thus, it is preferable that the depth W of the-reverse taper 7*a* is small to prevent the ejection voltage E from increasing.

Figure 17:
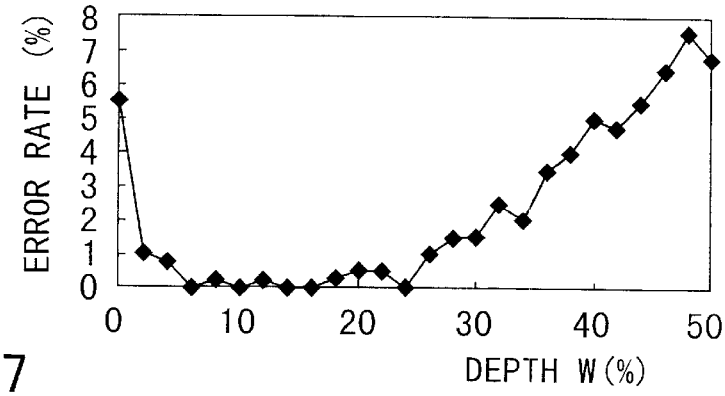
FIG. 17 is a graph showing a relationship between an error rate of ink ejection and a depth of the reverse taper in FIG. 12B.

Further, an occurrence rate of the ink-jet error angle exceeding ±5 mrad has been measured with respect to the depth W of the reverse taper 7*a*. A result of measurement is shown in FIG. 17. In FIG. 17, the depth W of the reverse taper 7*a* is also presented in its ratio to the thickness of the orifice plate 6 (a lamination member of the resin plate 14 and the liquid-repellent film 13). It is acceptable when the ink-jet error angle exceeding ±5 mrad occurs at a rate not grater than 2% of the total number of the orifices 7. This error rate can be obtained in the case where the depth W of the reverse taper 7*a* is $0<W<30\%$ of the thickness of the orifice plate 6. If the ejection voltage E is taken into account, it is preferable that the depth W of the reverse taper 7*a* is $0<W<20\%$ of the thickness of the orifice plate 6. In this case, the occurrence rate of the ink-jet error angle exceeding ±5 mrad is maintained within a desirable range not greater than 1% of the total number of the orifices 7.

When the constricted orifice 7 has the reverse taper 7*a* and the forward taper 7*b* shown in FIG. 12B, it obviously tends to provide high straightness in ejecting of jetting of ink drops. This tendency is almost same as for the orifice 7 having the straight portion 7*c* in FIG. 9.

As mentioned above, the reverse taper 7*a* and the forward taper 7*b* can be simultaneously formed by means of a single step of irradiating a laser beam constricted in the orifice plate 6, causing no alignment error between the reverse taper 7*a* and the forward taper 7*b*. Accordingly, this method facilitates a process of forming the orifice 7 in the orifice plate 6 and improves the process precision. Furthermore, it is possible to increase straightness of ink drops jetted from the orifice 7 and improve accuracy of the ejection accuracy of ink drops.

The laser beam is irradiated to the orifice plate 6 to form the orifice 7 after the orifice plate 6 is bonded to the head body 5 of the print head 3 with an adhesive. Thus, clogging of the orifice 7 due to the adhesive can be prevented.

The depth W of the reverse taper 7*a* of the orifice 7 is set according to the position of the focal plane for the laser beam shifted in the thickness direction of the orifice plate 6. The orifice 7 can be formed with an optimal shape for providing high straightness in jetting ink drops.

In addition, the laser beam can be also irradiated from the ink supply side to form the aforementioned orifice 7 in the orifice plate 6. However, it is preferable that the laser beam is irradiated from the ink discharge side, since it makes laser beam control easy and further improves the process precision. Especially, it is necessary that the orifice 7 be formed at a small diameter of a micron order. Accordingly, high controllability of the laser beam is an important advantage. Further, when the ink chamber 12 of the head body 5 is closed at an end opposite to the orifice plate 6, no laser beam can be irradiated from the ink supply side. Therefore, capability of irradiating the laser beam from the ink discharge side is another important advantage.

This embodiment explained a case where the liquid-repellent film 13 is provided as a surface of the orifice plate 6. Even when the liquid-repellent film 13 is not provided as the surface of the orifice plate 6, the orifice 7 having the reverse taper 7*a* and the forward taper 7*b* has attained high straightness in ink ejection similarly to the result in FIG. 15.

The orifice plate 6 formed with the liquid-repellent film 13 achieved a continuous ejection for ten minutes or more. In contrast, in the orifice plate 6 formed without the liquid-repellent film 13, clogging of the orifice 7 occurs due to ink adhered to and left on the orifice plate 6 after a continuous ejection for approximately four minutes.

Accordingly, it is desirable to use the orifice plate 6 with the liquid-repellent film 13 when the ejection continues for a long time.

This embodiment is explained for a manufacturing method in which the orifices 7 are formed by irradiating a laser beam after the orifice plate 6 is bonded to a leading end of the head body 5. The present invention is not necessarily limited to the above-mentioned embodiment. In manufacturing the print head 3, an orifice plate 6 of a given shape may be bonded to the head body 5 after a laser beam is irradiated to the orifice plate 6 in a manner similar to the embodiment to form orifices 7 of the specified shape.

In the embodiment described above, a pulse laser may be used as a laser source for irradiating a laser beam to gradually form an orifice. Also in this case, the orifice is formed without repeating a step of laser irradiation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A print head comprising:

an orifice plate having a plurality of orifices arranged as ink-jet nozzles; and a head body which is partitioned into a plurality of ink chambers and integrated with said orifice plate to guide ink from the ink chambers to the orifices;

wherein said head body increases an internal pressure of each ink chamber to eject ink from a corresponding orifice; and wherein each orifice comprises forward and reverse tapers forming a constriction which is symmetric with respect to a center axis of the orifice; and wherein said forward and reverse tapers have a boundary which serves as a narrowest part of the constriction.

2. A print head comprising:

an orifice plate having a plurality of orifices arranged as ink-jet nozzles; and a head body which is partitioned into a plurality of ink chambers and integrated with said orifice plate to guide ink from the ink chambers to the orifices;

wherein said head body increases an internal pressure of each ink chamber to eject ink from a corresponding orifice;

wherein each orifice comprises forward and reverse tapers forming a constriction which is symmetric with respect to a center axis of the orifice; and wherein an aperture size of said forward taper gradually decreases to a predetermined value in a thickness direction of said orifice plate from an ink supply side to an ink discharge side.

3. A print head according to claim 2, wherein said constriction restricts a direction of ink ejection to within an angle of ±5 mrad with respect to the center axis of the orifice.

4. A print head according to claim 2, wherein an aperture size of said reverse taper gradually increases from the predetermined value in the thickness direction of said orifice plate from the ink supply side to the ink discharge side.

5. A print head according to claim 2, wherein a depth of said reverse taper is not greater than 30% of a thickness of said orifice plate.

6. A print head according to claim 2, wherein a depth of said reverse taper is not greater than 20% of a thickness of said orifice plate.

7. A print head according to claim 2, wherein said orifice plate includes a liquid-repellent film formed as a surface on the ink discharge side and surrounding said reverse taper.

8. A print head manufacturing method comprising:

bonding an orifice plate to a head body which is partitioned into a plurality of ink chambers, irradiating said orifice plate with a laser beam to form a plurality of orifices which are arranged as ink-jet nozzles communicating with the ink chambers to eject ink in response to an increase in internal pressure of the ink chambers;

wherein each orifice is shaped by converging the laser beam using an imaging optical system whose focal plane is set inside said orifice plate so as to simultaneously form in each orifice a forward taper whose aperture size gradually decreases to a predetermined value in a thickness direction of the orifice plate from an ink supply side to an ink discharge side, and a reverse taper communicating with the forward taper.

9. A method according to claim 8, wherein said orifices are formed and shaped after said orifice plate is bonded to said head body.

10. A method according to claim 8, wherein said laser beam is irradiated onto a surface of said orifice plate on an ink discharge side.

11. A method according to claim 10, wherein said orifice plate includes a liquid-repellent film serving as the surface of said orifice plate onto which the laser beam is irradiated.

12. A method according to claim 11, wherein said orifices are shaped by irradiating the laser beam onto said liquid-repellent film in a state where said liquid-repellent film is adhesively covered with a protective film, and then removing said protective film after irradiation of the laser beam.

13. A method according to claim 8, wherein a depth of said reverse taper is determined by a position of the focal plane of said imaging optical system shifted in the thickness direction of said orifice plate.

14. A method according to claim 8, wherein an aperture size of said reverse taper gradually increases from the predetermined value in the thickness direction of said orifice plate from the ink supply side to the ink discharge side.

15. A method according to claim 8, wherein a depth of said reverse taper is not greater than 30% of a thickness of said orifice plate.

16. A method according to claim 8, wherein a depth of said reverse taper is not greater than 20% of a thickness of said orifice plate.

17. An orifice plate comprising:

a lamination member comprising a resin plate and a liquid-repellent film covering the resin plate;

a plurality of orifices arranged as ink-jet nozzles in said lamination member;

wherein each orifice comprises a constriction formed by a combination of a forward taper whose aperture size gradually decreases to a predetermined value in a thickness direction of said lamination member from an ink supply side to an ink discharge side, and a reverse taper communicating with the forward taper and having a depth not greater than 30% of a thickness of said lamination member.

18. An orifice plate according to claim 17, wherein the depth of said reverse taper is not greater than 20% of the thickness of said lamination member.

19. An orifice plate manufacturing method comprising:

forming a lamination member from a resin plate and a liquid-repellent film;

irradiating said lamination member with a laser beam to form a plurality of orifices arranged as ink-jet nozzles in said lamination member;

wherein each orifice is shaped by converging the laser beam using an imaging optical system whose focal plane is set inside said lamination member so as to simultaneously form in each orifice a forward taper whose aperture size gradually decreases to a predetermined value in a thickness direction of the lamination member from an ink supply side to an ink discharge side, and a reverse taper communicating with the forward taper and having a depth not greater than 30% of a thickness of said lamination member.

20. A method according to claim 19, wherein the depth of said taper is not greater than 20% of the thickness of said lamination member.

* * * * *